US008511218B2

(12) United States Patent
Cordes et al.

(10) Patent No.: US 8,511,218 B2
(45) Date of Patent: Aug. 20, 2013

(54) CLAMPING DEVICE FOR CYLINDER SLEEVES AND USE THEREOF, AND MUD PUMP HAVING A CLAMPING

(75) Inventors: Malte Cordes, Rheine (DE); Michael Gelker, Lingen (DE)

(73) Assignee: Bentec GmbH Drilling & Oilfield Systems, Bad Bentheim (DE)

( * ) Notice: Subject to any disclaimer, the term of this patent is extended or adjusted under 35 U.S.C. 154(b) by 73 days.

(21) Appl. No.: 13/154,198

(22) Filed: Jun. 6, 2011

(65) Prior Publication Data

US 2011/0236238 A1 Sep. 29, 2011

Related U.S. Application Data

(63) Continuation of application No. PCT/DE2009/001705, filed on Dec. 3, 2009.

(30) Foreign Application Priority Data

Dec. 8, 2008 (DE) ..... 10 2008 060 659

(51) Int. Cl.
*F01B 29/00* (2006.01)
*F01B 31/12* (2006.01)
*F16J 10/04* (2006.01)

(52) U.S. Cl.
USPC ..... 92/128; 92/5 R; 92/171.1

(58) Field of Classification Search
USPC ..... 92/5 R, 128, 169.1, 169.2, 171.1
See application file for complete search history.

(56) References Cited

U.S. PATENT DOCUMENTS

| | | | |
|---|---|---|---|
| 2,823,689 | A | 2/1958 | Healy |
| 3,820,381 | A | 6/1974 | Thurston |
| 4,131,050 | A | 12/1978 | Holmes |
| 4,525,114 | A | 6/1985 | Hirst |
| 4,773,272 | A | 9/1988 | Trungold |

(Continued)

FOREIGN PATENT DOCUMENTS

| | | |
|---|---|---|
| AT | 269655 | 3/1969 |
| DE | 10 61 625 B | 7/1959 |

(Continued)

OTHER PUBLICATIONS

Office Action in German priority application DE 10 2008 060 659.6, filed Dec. 8, 2008, dated Oct. 11, 2011 (5 pgs.).

(Continued)

*Primary Examiner* — Michael Leslie
(74) *Attorney, Agent, or Firm* — Shlesinger, Arkwright & Garvey LLP.

(57) ABSTRACT

Clamping device for cylinder sleeves of a pump system, and a piston pump or plunger pump for conveying drilling fluid during drilling of boreholes, particularly in the field of oil and natural gas production, and its use. Pump system includes a pump unit and a driving rotary drive unit. Clamping device for cylinder sleeve of a piston pump or plunger pump includes a cylinder sleeve receptacle, a clamping element provided at the pump, and cylinder sleeve or a portion of the cylinder sleeve provided between the clamping element and the cylinder sleeve receptacle, Clamping element and cylinder sleeve receptacle are connected by a connecting apparatus.

14 Claims, 3 Drawing Sheets

(56) References Cited

U.S. PATENT DOCUMENTS

| | | | | |
|---|---|---|---|---|
| 4,981,404 | A | 1/1991 | Chamberlain et al. | |
| 5,226,765 | A * | 7/1993 | Walton | 411/14 |
| RE37,483 | E | 12/2001 | Kennedy et al. | |
| 6,581,698 | B1 | 6/2003 | Dirks | |
| 6,857,483 | B1 | 2/2005 | Dirks et al. | |
| 2008/0093361 | A1 * | 4/2008 | Kennedy et al. | 220/233 |
| 2012/0152619 | A1 | 6/2012 | Hofste et al. | |

FOREIGN PATENT DOCUMENTS

| | | | |
|---|---|---|---|
| DE | 2 330 066 | | 1/1974 |
| DE | 28 29 533 | | 1/1979 |
| DE | 38 31 909 | | 3/1990 |
| DE | 10 2008 060 659 | A1 | 12/2008 |
| EP | 2 356 339 | B1 | 4/2013 |
| WO | WO 2008/074428 | | 6/2008 |

OTHER PUBLICATIONS

PCT Internationaler Vorläufiger Bericht Über Die Patentierbarkeit [PCT International Preliminary Report on Patentability], dated Oct. 29, 2010 (4 pgs.).

International Search Report of PCT/DE2009/001705, dated Jun. 1, 2010 (4 pgs.).

Office Action in German priority application DE 10 2008 060 659.6, filed Dec. 8, 2008, dated Apr. 1, 2011 (4 pgs.).

English Translation of PCT Internationaler Vorläufiger Bericht Über Die Patentierbarkeit [PCT International Preliminary Report on Patentability], in application PCT/DE2009/001705, filed Dec. 3, 2009, dated Jun. 16, 2011 (4 pgs.).

DE search report of Nov. 23, 2012 in related DE 10 2011 056 712.7, filed in 2011 (5 pages).

* cited by examiner 17
39
1
16
6
4
4a
8
11
10
9a
26
9
20
15
5
5a
18
19
5b
9a
9b
7
9
3
12
7a
25
2
2a
28

CLAMPING DEVICE FOR CYLINDER SLEEVES AND USE THEREOF, AND MUD PUMP HAVING A CLAMPING

CROSS-REFERENCE TO RELATED APPLICATIONS

This application is a continuation of application no. PCT/DE2009/001705, filed Dec. 3, 2009, which claims the priority of German application no. 10 2008 060 659.6, filed Dec. 8, 2008, and each of which is incorporated herein by reference.

FIELD OF THE INVENTION

The invention relates to a clamping device for cylinder sleeves of a pump system, and a piston pump or plunger pump for conveying drilling fluid during drilling of boreholes, in particular in the field of oil and natural gas production. This pump system consists of a pump unit and a driving rotary drive unit. The invention further relates to the use of a clamping device in a piston pump or plunger pump.

BACKGROUND OF THE INVENTION

In the drilling of boreholes, the injection of mud, and drilling mud, respectively, into the drill string or the borehole via the pump system serves several purposes. The drilling mud is used to remove the extracted drill cuttings and spoils, and to cool and lubricate the drilling tool or its drive located at the bottom of the borehole. The pressure generated in the borehole must be equalized with the gases and liquids present in the surrounding rock.

Extremely powerful pump systems are necessary for producing the required volumetric flow, which is in the range of 3000 l/min, and for generating the required pressure, which may be as high as 500 bar.

It is standard practice to produce pressure and volumetric flow via the motion of one or more displacement elements (pistons) which provide a periodically changing work space which is sealed from the outside.

These reciprocating piston machines are characterized in that they carry out the rotating motion of the rotary drive unit via a crank mechanism in an axial motion, which moves the piston. The design of the piston as a plunger represents one variation.

The work space is formed by the cylinder sleeve and the piston which travels therein.

In its specialized use in mud pumps, the cylinder sleeve has distinctive features compared to internal combustion engines or other piston pumps, for example.

On the one hand, these cylinder sleeves are subjected to greater wear due to the pumping medium, i.e., the drilling mud, which is extremely corrosive and in particular is abrasive due to solids.

On the other hand, the pressure and volumetric flow in a mud pump may be adjusted not just by varying the rotational speed, but also by varying the piston that is used. This is achieved by inserting various pistons together with matching cylinder sleeves into the pumps.

Thus, the following requirements are imposed on the cylinder sleeve and in particular on its fastening:

Due to wear as well as adjustments and changes to the system at different pressures and volumes, the fastening must allow short setup times and a low expenditure of effort.

The cylinder sleeve must be pressed with a defined contact force against the receptacle in order to ensure the function of the seal at that location. Both components form the high-pressure partial region of the system. Leaks in this region are hazardous as well as costly.

The working environment as well as the tool that is used must be characterized in the field of the drilling industry as extremely rough and harsh. In addition, the drilling mud that is used is generally corrosive. Thus, robustness and resistance to corrosion represents another requirement of a fastening device.

According to the known prior art, cylinder sleeves are connected to the pressure-conducting part of the mud pump, referred to as the water portion, using three different systems.

The first system has a wing clamp having a conical flank, for which the contact force is produced by a cone. The contact force is produced by screws which tighten the clamp around the cylinder sleeve and the receptacle. The straight flank of the clamp lies against the cylinder sleeve, and the conical portion of the clamp lies against the receptacle on the corresponding counterpart.

The wing clamps have the major disadvantage that they are very unwieldy, and the torque may be applied to the cylinder sleeve only in a very imprecise manner using a torque wrench. In addition, this factor varies greatly as a result of the conical surface, which may become worn or soiled (oily), which has a direct influence on the contact force that is being transmitted. Installing the clamp requires a great expenditure of force and also entails a certain risk of injury. Monitoring of the contact force is not possible without retightening.

The second system has a hydraulically pretensioned bolt having a spring clamp. In this system the supporting bolts are elongated using a hydraulic pump, or the hydraulic force acts against a separate spring assembly, thus causing a deflection. The system is screwed on without torque. After the pressure is released, the required contact force present in the system is solely mechanical.

The hydraulic system offers the major advantage of a precise contact force on the cylinder sleeve, which is also referred to as a liner. However, it is disadvantageous that the cylinder sleeve and the clamping element must be lifted in two crane hoisting operations, and therefore separately. In addition, a hydraulic pump and hydraulic fluid must be present. The hydraulic components and in particular the filler are susceptible to damage, or are subject to failure and the need for frequent repairs. Due to the more complex design, the system is approximately twice as expensive as the wing clamp having a liner receptacle. Here as well, subsequent monitoring of the contact force is not possible, although there is a risk of the cylinder sleeve or liner detaching or loosening as the result of vibration from the drilling operation or the drilling mud injection process.

The third system clamps the cylinder sleeve by means of an external thread. The clamp has an element with an external thread which is placed over the cylinder sleeve and is supported on same. These elements are jointly screwed into an internal thread provided on the water portion, the required contact force being applied as a result of the pitch of the thread.

This system has a very simple mechanical design and is also easy to operate. A very uniform contact force is applied to the seal via the thread. However, the only possibility for applying torque, which, however, is very imprecise, is for the nut to be continuously struck with a hammer with the full strength of the installer. The only monitoring is leak inspection during operation. The thread is also susceptible to corrosion and damage, which together with the accompanying wear results in even greater variation of the contact force. In addition, the strength of the installer is a factor that is not easily calculated.

DE 3831909 A1 discloses a hydraulic cylinder having a cylindrical pipe and an end flange with a guide bore for a piston rod. The end flange is inserted into the cylindrical pipe using a plug-in socket. The cylindrical pipe is surrounded by a clamping ring in the region of the plug-in socket. In addition, mounting holes for accommodating clamping screws are provided, orthogonal to the longitudinal axis of the guide bore, which pass through the clamping ring, the cylindrical pipe, and the plug-in socket. An end flange/cylindrical pipe connection may thus be easily and quickly established in a modular system composed of prefabricated component parts, thus saving on manufacturing costs. This pipe/flange connection is used as a pneumatic or hydraulic motor, in particular as a drive for swivel arms in the field of robotics. In one particular design, it is described that the end flange and the plug-in socket are designed as a one-part component, and have a shared guide bore for the piston rod, sealing rings being supported in the guide bore and on the plug-in socket, resulting in proper sealing of the plug-in socket with the cylindrical pipe and the piston rod in the piston rod guide. During installation, the clamping ring is prevented from twisting by means of a centering pin on the cylindrical pipe for introduction of the mounting holes, by means of which the centering pin penetrates through the cylindrical pipe until reaching the plug-in socket. DE 3831909 A1 also discloses that a closed end flange without a guide bore for the piston rod is clamped with its plug-in socket in the other end of the cylindrical pipe in the same manner as the end flange having a guide bore for the piston rod, forming a cylinder cover and base.

The disadvantage of DE 3831909 A1 is the guiding of the piston rod in the cylinder, resulting in a statically indeterminate bearing of the piston rod, which causes increased wear on multiple wearing parts. This guiding also requires time-consuming replacement of the piston. Rapid installation and deinstallation of the piston and the cylinder sleeve is therefore not possible. In addition, the supplying of pressure media is complicated, and cannot be used in a pump having an integrated pressure media supply system. Another disadvantage is the action on the described pipe/flange connection, which is directed orthogonally with respect to the longitudinal axis of the plug-in socket.

U.S. Pat. No. 4,981,401 discloses an adjustable clamping screw having an adjustable stress level. The publication describes a screw which is introduced into an axial cavity, by means of which the stress within the component may be measured. The screw also includes a display which indicates, as soon as the screw is in use, that a preset value has been reached.

The adjustable stress-measuring bolt disclosed in U.S. Pat. No. 4,981,401 has a complicated mechanism which allows incorrect operation, and which due to the prevailing harsh conditions is not suitable for applications for conveying drilling fluid in the drilling of boreholes.

WO 2008/074428 A1 describes a fluid processing machine for compressing or conveying fluids, preferably for compressing gases to high pressures, having a linear motor, at least one cylinder, a solid piston which is axially movable in the cylinder or an axially movable liquid piston, and at least one compression space which is formed between the cylinder and the solid piston or the liquid piston. The linear motor transfers a translational driving force to the solid piston or to the liquid piston. In the described fluid processing machine, the leakage-free and lubricant-free compression and conveying of fluids at high pressures is made possible by a simple design, the solid piston being translationally driven by the traveling magnetic field of the linear motor which is generated by coils.

The cited document does not disclose a particular fastening of the cylinder of the fluid processing machine which is suitable for ensuring short setup times and a low expenditure of effort, especially in a harsh environment.

OBJECTS AND SUMMARY OF THE INVENTION

An object of the invention, therefore, is to provide a fastening device which avoids the disadvantages of the prior art and at the same time is inexpensive and easy to use, and which ensures a uniform and defined contact force on the sealing face of the cylinder sleeve, and therefore ensures its function. A further object of the invention is a piston pump or plunger pump that is suited for this purpose, and a method for installation.

The object is achieved by each of the embodiments of the clamping devices according to the invention and by each of the embodiments of the method for installing a cylinder sleeve for a piston pump or a plunger pump using a clamping device according to the invention.

The clamping device according to the invention for a cylinder sleeve of a piston pump or plunger pump includes that a cylinder sleeve receptacle and a clamping element are provided at the piston pump or plunger pump, and the sleeve or a portion of the cylinder sleeve is situated between the clamping element and the cylinder sleeve receptacle, and the clamping element and the cylinder sleeve receptacle are connected to one another by a connecting apparatus, or fastening element, and the connecting apparatus or the clamping element having devices for measuring or monitoring at least one elongation stress. Using this device, it is advantageously possible to provide the contact force uniformly on the sealing face of the cylinder sleeve, and during installation and operation of the pump to easily, reliably, and quickly measure and thus monitor the contact force or elongation stress without additional tools or measuring devices.

One preferred clamping device includes that the outer diameter of the cylinder sleeve or of a portion of the cylinder sleeve is configured to be larger than the inner diameter of the cylinder sleeve receptacle and/or of the clamping element, thus advantageously allowing the use of existing or available liners or cylinder sleeves. In addition, handling is simplified, and the design of the clamping device is optimized for use. Cylinder sleeves having an inner diameter of 3 to 10 inches, preferably 5 to 7.5 inches, are preferably used.

Another advantageous embodiment of the clamping device according to the invention provides that the clamping element is configured as part of the cylinder sleeve. Handling during installation or deinstallation may thus be improved due to the fewer number of parts.

One particularly preferred embodiment of the clamping device according to the invention includes that a guide element for the cylinder sleeve, preferably in the form of a shell, is situated on the clamping element, thus allowing improved and easier guiding and handling of the cylinder sleeve during installation and deinstallation, and providing better protection against tilting as well as damage.

Another very advantageous clamping device according to the invention includes that at least one device for the insertion and removal, preferably a hoisting eye, is situated on the clamping element and/or the guide element and/or the cylinder sleeve. This allows easier handling, in particular when the configuration is matched to the design of the device. The configuration of the insertion and removal device is optimally matched to the clamping element, the guide element, and/or the cylinder sleeve when the cylinder sleeve is oriented approximately axially with respect to the cylinder sleeve receptacle when the cylinder sleeve is lifted.

One preferred clamping device is configured in such a way that the cylinder sleeve receptacle is configured as part of the piston pump or plunger pump housing or of the valve block of the piston pump or plunger pump, resulting in the advantage of an improved and simpler design.

Another advantageous clamping device provides that the connecting apparatus in each case is composed of a fastening element, preferably a stay bolt having an axially extending borehole in the form of a shank, in which a measuring or monitoring device is situated, composed of a measuring pin which projects beyond the end face of the fastening element, and which at its inner end is preferably anchored to the shank, and which has a rotatable display element at the projecting end which is freely rotatable when the fastening element is not under stress, but which cooperates with the end face of the fastening element under pressure, and is protected, or secured, against twisting when the fastening element is subjected to a predefined tensile stress or elongation stress. As the result of this preferred embodiment it is not necessary to use a tool or additional measuring devices to carry out measurement and monitoring of the elongation stress or the contact pressure on the cylinder sleeve during installation or operation of the mud pump.

One particularly advantageously configured clamping device includes that a further measuring or monitoring device, composed of a second measuring pin which projects beyond the end face of the first measuring pin, is situated on a measuring or monitoring device, the first measuring pin having an axially extending borehole in the form of a shank, and the second measuring pin at its inner end preferably being anchored to the shank of the first measuring pin or to the shank of the fastening element, and having a second rotatable display element at the projecting end which is freely rotatable when the fastening element is not under stress, but which cooperates with the end face of the first measuring pin or with the first display element under pressure, and is protected against twisting when the first measuring pin is subjected to a second predefined tensile stress. This preferred clamping device may be used to measure not only a specified minimum force, but also a maximum force, which in particular allows excessive stress on the clamping device or the cylinder sleeve to be monitored. In addition to monitoring of all fastening elements for uniform elongation stress and therefore contact force on the cylinder sleeve, this also allows monitoring of the first measuring device.

One preferred variant of the clamping device according to the invention provides that cylinder sleeves having the same outer diameter and different inner diameters may be used, thus advantageously allowing the same clamping device to be used for cylinder sleeves having different sizes of pistons or plungers, and thus to be used in different power ranges of the mud pumps.

A piston or plunger which is matched to the inner diameter of the cylinder sleeve, and with which the cylinder sleeve cooperates and which is connected to a drive, is provided in each cylinder sleeve.

In further advantageous embodiments of the clamping device according to the invention, a seal is situated between the cylinder sleeve and the wear plate or between the cylinder sleeve and the valve block. The seal for the cylinder sleeve or for the injection system is thus improved and optimized.

Also advantageous is the configuration of the clamping device according to the invention in which indentations are provided externally on the cylinder sleeve and/or internally in the cylinder sleeve receptacle. The indentations facilitate the guiding during installation and deinstallation of the cylinder sleeves, as the friction surfaces are reduced while still ensuring optimal guiding.

The piston pump or plunger pump according to the invention for use as a mud pump has at least one of the above-described advantageous clamping devices for a cylinder sleeve. The disadvantages of the mud pumps according to the prior art are thus avoided, and the conveying of drilling mud of the type described at the outset is optimized due to less complexity, in particular in the simplified installation and deinstallation of the cylinder sleeves.

The method according to the invention for installing a cylinder sleeve of a piston pump or plunger pump includes the advantageous use of one of the clamping devices described herein, resulting in simpler and more reliable installation.

One embodiment of the invention is illustrated in the drawings and described in greater detail below.

DETAILED DESCRIPTION OF THE INVENTION

Figure 1:
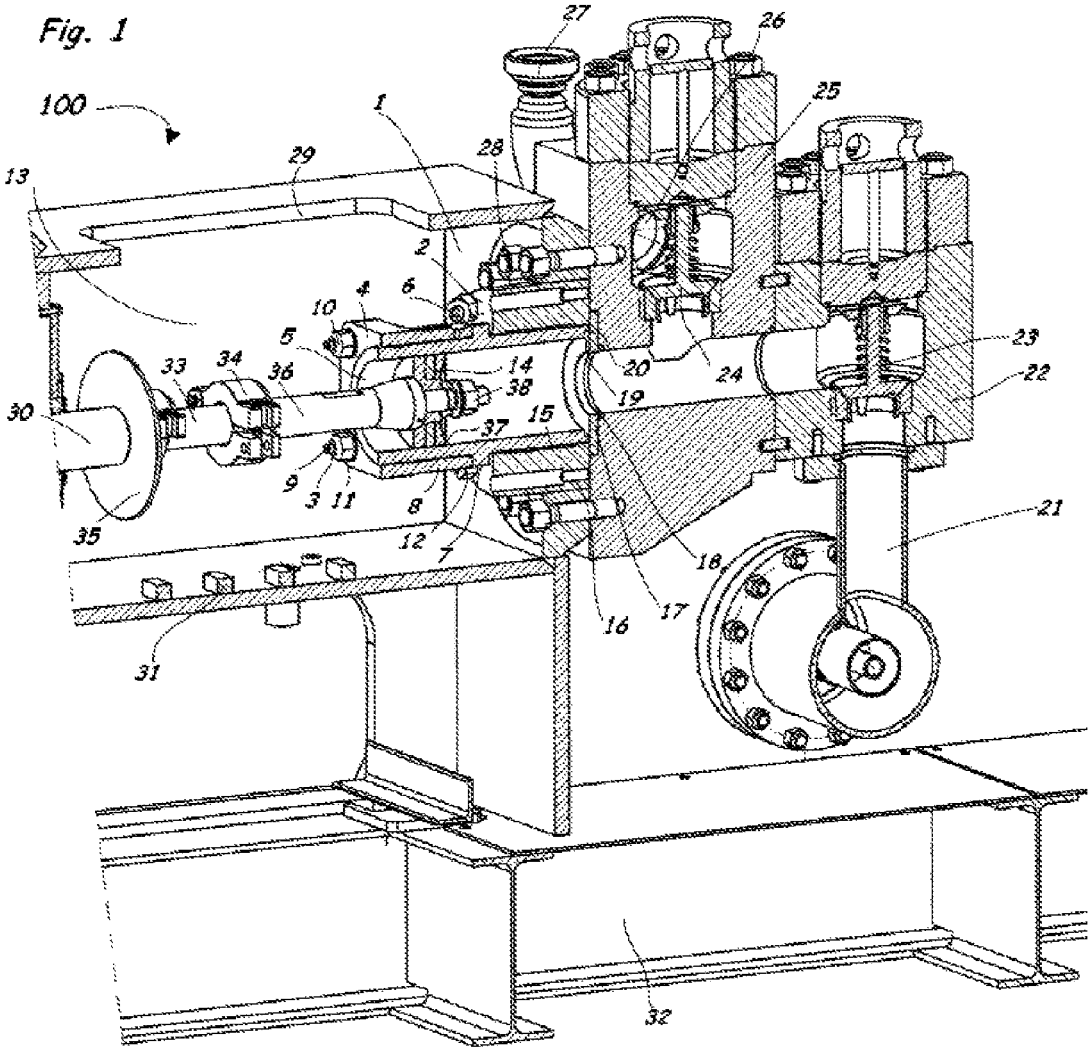
FIG. 1 shows a clamping device for a cylinder sleeve as part of a mud pump.

FIG. 1 shows a clamping device for a cylinder sleeve 5 as part of a mud pump. The cross section of the front portion of a mud pump is illustrated, a mud pump having the clamping device 5 according to the invention being represented by reference numeral 100. Depending on the configuration, a mud pump may have multiple cylinder sleeves together with the corresponding piston or plunger.

The piston rod 36 projects from the left into the pump housing 13, which is shown in a cutaway view in a partial illustration. The piston rod is composed of a crosshead piston rod 30 on which is mounted a baffle plate 35 which protects the portion of the pump behind the baffle plate from drilling mud discharge in the event of seal failure. A connecting element 33 is fastened to the crosshead piston rod 30 via a wing clamp. The actual piston rod 36 is connected to the connecting element 33 via a further wing clamp 34. The actual piston 14 is fastened at its front end via the piston nut 38. The connecting element 33, wing clamp 34, and piston nut 38 are used for rapid installation and deinstallation of the piston 14 and cylinder sleeve 5.

The cylinder sleeve 5 is sealed via its sealing face 20 with respect to the valve block 25. In the illustrated case, the seal assembly is represented as follows: a seal 19 is situated in front of the cylinder sleeve 5, i.e., at the sealing face 20 thereof. The seal presses on a wear plate 17 which is used to keep flushed materials away from, and prevent damage to, the valve block 25. The wear plate 17 likewise seals off the actual valve block via a seal 18. The cylinder sleeve 5 is pressed against the seal assembly via the cylinder sleeve receptacle 2 and the fastening elements 3, whereby the required pressure must be applied to the sealing face 20 or seal 18. The illustrated device is shown enlarged and described in greater detail with reference to FIGS. 2 and 3.

The piston 14 is set in translational motion by means of the crosshead piston rod 30 and the crank mechanism and rotary drive unit connected thereto. Drilling mud is drawn in and discharged by the back-and-forth motion of the piston 14 and the production of a pressure-tight space via the sealing face 37. The fluid is drawn into the suction-side valve block 22 by means of the drilling mud flow 21 via the internally situated valve 23. In the pre-stroke this valve 23 closes, and the fluid is pressed under pressure into the central pressure line 26 via the pressure-side valve 24, the central pressure line interconnecting all other cylinders (not illustrated here). The fluid exits the mud pump at 27.

Valve blocks 22 and 25 are interconnected, and together are screwed via the screw connection 28 to the front plate 1 of the mud pump housing 13. The entire housing 13 is mounted on a stable frame or carriage 32.

Figure 2:
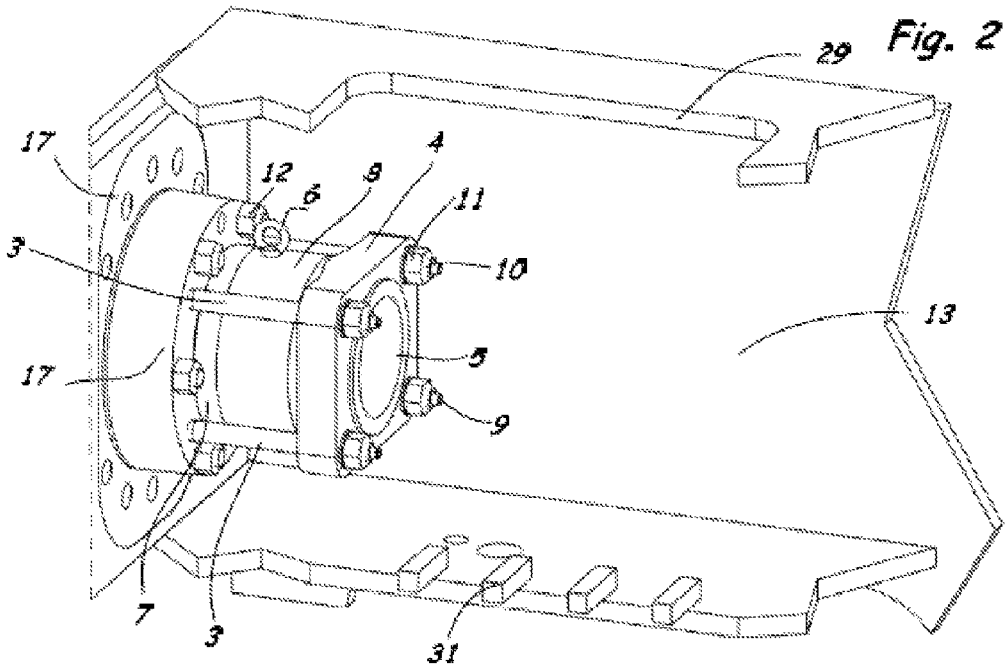
FIG. 2 shows a clamping device for a cylinder sleeve of a mud pump in an oblique view.

FIG. 2 shows a clamping device for cylinder sleeves of a mud pump. The cylinder sleeve receptacle 2 is mounted on the front plate 1 of a pump housing 13, only partially illustrated, of a mud pump. The cylinder sleeve receptacle 2 accommodates the front portion of the liner or the cylinder sleeve 5, and together with the water portion of the mud pump forms a pressure space which in the present embodiment is configured for an operating pressure of up to 350 bar. At its rear end the cylinder sleeve 5 is guided by a clamping element 4, which on the pump side is connected to a further shell-shaped cylinder sleeve guide element 8. This cylinder sleeve guide element 8 is fixedly connected to the clamping element 4. For easier and faster insertion and removal of the cylinder sleeve 5, a hoisting eye 6 is situated on the top part of the cylinder sleeve guide element 8, by means of which the clamping element 4, including the cylinder sleeve 5 located therein, may be more easily connected to the cylinder sleeve receptacle 2, i.e., the valve block 25, or the front plate 1 of the pump housing. The hoisting eye 6 may also be provided on the clamping element 4, and is advantageously used as an installation aid for the cylinder sleeve 5. Providing the hoisting eye 6 on the clamping element 4 or the cylinder sleeve guide element 8 in such a way that in the lifting position the cylinder sleeve 5 is in an approximately horizontal position is particularly advantageous for easier insertion, without tilting or damage, into the cylinder sleeve receptacle 2. Multiple hoisting eyes may also be provided on the clamping element 4 and/or the cylinder sleeve guide element 8 as an installation aid.

Figure 3:
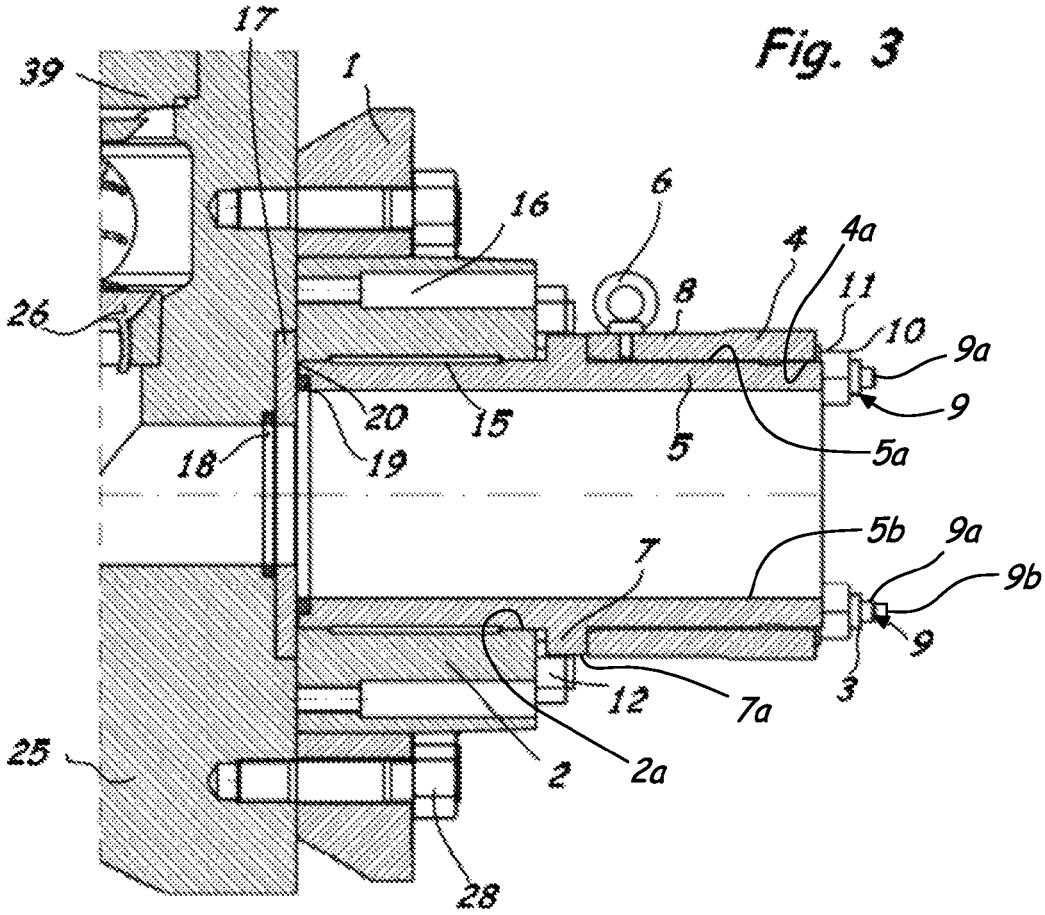
FIG. 3 shows a cross section of the clamping device together with a cylinder sleeve.

The piston (not illustrated), which is matched to the cylinder sleeve 5, is axially guided therein. Depending on the requirements, the inner diameter 5*b* of the cylinder sleeve 5 may have different diameters. In the present embodiment, the outer diameter 5*a* of the cylinder sleeve 5, except for a clamping shoulder 7, corresponds to the inner diameter 4*a* of the clamping element 4 and to the cylinder sleeve guide element 8. In its front side facing the valve block 25, the cylinder sleeve 5 in a partial region (the clamping shoulder 7) has an outer diameter 7*a* that is larger than the inner diameter 4*a* of the clamping element 4 and of the cylinder sleeve guide element 8, and of the inner diameter 2*a* of the cylinder sleeve receptacle 2. By means of the stay bolts as fastening elements 3, the portion of the cylinder sleeve 5 having the larger outer diameter is fixedly clamped between the clamping element 4 and, in the present preferred embodiment, the cylinder sleeve guide element 8 on the one side, and the cylinder sleeve receptacles 2 on the other side. Four stay bolts are used in this embodiment. However, three, or more than four, connecting elements 3 may also be used. The stay bolts are screwed to the cylinder sleeve receptacle 2. On their side opposite from the cylinder sleeve receptacle 2 the fastening elements 3, i.e., stay bolts, have a head 11 of the fastening element 3, at the end face 10 of which a measuring device 9 projects. The measuring device 9 is a device for measuring or monitoring at least one elongation stress. The elongation measurement is used in particular for monitoring the contact force of the sealing face on the cylinder sleeve 5 at the pressure-conducting element of the mud pump-in the current example, the wear plate 17 or the valve block 25. Such fastening elements 3 having a torque or stress measuring device 9 at the head are generally also referred to as a ROTABOLT® . ROTABOLT® is a registered trademark of James Walker Rotabolt Limited of Surrey, United Kingdom (UK). The torque or stress measuring device 9 has a rotatable display element 9*a* as shown in FIGS. 1-3, FIG. 3 being an enlarged view. Rotatable display element 9*a* may be termed a first display element. As shown in FIG. 3, a further or second measuring device 9*b* having a rotatable display element may be provided on measuring device 9 and on display element 9*a* thereof as will be readily understood to a person having ordinary skill in the art. Further measuring device 9*b* of stress measuring device 9, and rotatable display element 9*a* are each respectively freely rotatable when the fastening element 3 is not under stress. They are protected or secured against twisting or rotation when the fastening element is under pressure as described herein.

The portion of the cylinder sleeve 5 having a larger outer diameter than the remainder of the cylinder sleeve 5 is referred to in the present case as the clamping shoulder 7 of the cylinder sleeve 5. The clamping shoulder 7 is designed in such a way that it is to be securely and tightly clamped between the cylinder sleeve receptacle 2 and the clamping element 4.

FIG. 3 illustrates a cross section of the clamping device in cooperation with the cylinder sleeve. The manner in which the cylinder sleeve 5 is pressed against the valve block 25 by means of the clamping shoulder 7 and the clamping element 4 is readily apparent. As illustrated in the present example, the cylinder sleeve 5 and/or the cylinder sleeve receptacle 2 may have indentations on the fitting surface 15 which advantageously reduce the friction surface and allow easier guiding during insertion and removal of the cylinder sleeve 5.

To produce a pressure-tight space between the two elements, namely, the valve block 25 and the cylinder sleeve 5, in the present example the seal elements have the following arrangement. At the sealing face 20 the cylinder sleeve 5 presses against the wear plate 17, thus compressing the seal 19.

The cylinder sleeve 5 is guided on one side in the shell 8 of the clamping element 4, and on the other side is guided in the cylinder sleeve receptacle 2. The cylinder sleeve receptacle is fixedly connected to the valve block 25 via the screw connection 12, and for deinstallation may be removed via the extraction holes 16.

The valve block 25 is also connected to the front plate 1 of the mud pump via the screw connection 28.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

List of Reference Numerals

1. Front plate of pump housing

2. Cylinder sleeve receptacle

3. Fastening element together with measuring device

4. Clamping element
5. Cylinder sleeve
6. Hoisting eye
7. Clamping shoulder of cylinder sleeve 5
8. Guide element (shell shaped)
9. Measuring device on fastening element 3
10. End face on the head 11 of fastening element 3
11. Head of fastening element 3
12. Screw connection of cylinder sleeve receptacle 2 to valve block 25
13. Mud pump housing
14. Piston
15. Fitting surface between cylinder sleeve 5 and receptacle 2
16. Extraction holes for cylinder sleeve receptacle 2
17. Wear plate between cylinder sleeve 5 and valve block 25
18. Sealing element between wear plate 17 and valve block 25
19. Sealing element between cylinder sleeve 5 and wear plate 17
20. Sealing face of cylinder sleeve 5
21. Drilling mud flow
22. Valve block (suction side)
23. Valve (suction side)
24. Valve (pressure side)
25. Valve block (pressure side)
26. Central pressure line between the valve blocks
27. Pressurized discharge exit
28. Screw connection of front plate 1 to valve block 25
29. Opening to cylinder sleeve chamber
30. Crosshead piston rod
31. Tool support shoulders for deinstallation
32. Fastening frame for mud pump
33. Connecting element between crosshead piston rod 30 and piston rod 36
34. Wing clamp for connecting element 33 and piston rod 36
35. Baffle plate for drilling mud discharge
36. Piston rod
37. Sealing face of piston 14 with respect to cylinder sleeve 5
38. Piston nut
39. Valve cover
100. Mud pump

What is claimed is:

1. Clamping device, comprising:
a) a clamping element, a fastening element, a cylinder sleeve receptacle, and a cylinder sleeve for a piston pump or plunger pump;
b) the cylinder sleeve or a portion of the cylinder sleeve being situated between the clamping element and the cylinder sleeve receptacle;
c) the clamping element and the cylinder sleeve receptacle being connected to one another by the fastening element;
d) the fastening element being situated axially with respect to the longitudinal axis of the cylinder sleeve; and
e) the fastening element or the clamping element having a device for at least one of measuring and monitoring at least one elongation stress.

2. Clamping device according to claim 1, wherein:
a) the outer diameter of the cylinder sleeve or the outer diameter of a portion of the cylinder sleeve is configured to be larger than the inner diameter of the cylinder sleeve receptacle or the inner diameter of the clamping element.

3. Clamping device according to claim 1, wherein:
a) the clamping element is configured as part of the cylinder sleeve.

4. Clamping device according to claim 3, wherein:
a) a guide element for the cylinder sleeve is provided on the clamping element.

5. Clamping device according to claim 4, wherein:
a) at least one device for insertion and removal is situated on one of the clamping element, the guide element, and the cylinder sleeve.

6. Clamping device according to claim 1, wherein:
a) the cylinder sleeve receptacle is configured as part of one of the piston pump or plunger pump housing, and a valve block of the piston pump or plunger pump.

7. Clamping device according to claim 1, wherein:
a) the fastening element includes a stay bolt having a head in which the device for at least one of a measuring and monitoring is provided which projects beyond an end face of the head, and which has a rotatable display element at the projecting end which is freely rotatable when the fastening element is not under stress, but which cooperates with the end face of the head under pressure and is secured against twisting; and
b) the clamping device is adjustable to a predefined tensile stress or elongation stress of the fastening element.

8. Clamping device according to claim 7, wherein:
a) a further measuring or monitoring device is provided on the measuring or monitoring device, the further measuring or monitoring device being a second measuring device which projects beyond the end face of the first measuring device, and the second measuring device having a rotatable display element which is freely rotatable when the fastening element is not under stress, but which cooperates with the first measuring device under pressure and is secured against twisting; and
b) the clamping device being adjustable to a second predefined tensile stress of the first measuring device which is greater than the first predefined tensile stress or elongation stress.

9. Clamping device according to claim 1, wherein:
a) cylinder sleeves having the same outer diameter and different inner diameters may be used.

10. Clamping device according to claim 1, wherein:
a) a piston or plunger whose outer diameter is matched to the inner diameter of the cylinder sleeve and which is connected to a drive is provided in the cylinder sleeve.

11. Clamping device according to claim 1, wherein:
a) a seal is one of provided between the cylinder sleeve and the wear plate and between the cylinder sleeve and a valve block.

12. Clamping device according to claim 1, wherein:
a) indentations are provided one of externally on the cylinder sleeve and internally in the cylinder sleeve receptacle.

13. Piston pump or plunger pump for use as a mud pump, comprising:
a) a clamping device, the clamping device including:
i) a clamping element, a fastening element, a cylinder sleeve receptacle, and a cylinder sleeve for a piston pump or plunger pump;
ii) the cylinder sleeve or a portion of the cylinder sleeve being situated between the clamping element and the cylinder sleeve receptacle;
iii) the clamping element and the cylinder sleeve receptacle being connected to one another by the fastening element;
iv) the fastening element being situated axially with respect to the longitudinal axis of the cylinder sleeve; and v) the fastening element or the clamping element having a device for at least one of measuring and monitoring at least one elongation stress.

14. Method for installing a cylinder sleeve for a piston pump or plunger pump, comprising:

a) providing a clamping device, the clamping device including:

i) a clamping element, a fastening element, a cylinder sleeve receptacle, and a cylinder sleeve for a piston pump or plunger pump;

ii) the cylinder sleeve or a portion of the cylinder sleeve being situated between the clamping element and the cylinder sleeve receptacle;

iii) the clamping element and the cylinder sleeve receptacle being connected to one another by the fastening element;

iv) the fastening element being situated axially with respect to the longitudinal axis of the cylinder sleeve; and v) the fastening element or the clamping element having a device for at least one of measuring and monitoring at least one elongation stress;

b) removing the cylinder sleeve from the cylinder sleeve receptacle; and c) installing a further cylinder sleeve in the cylinder sleeve receptacle.

* * * * *